United States Patent [19]

Lai et al.

[11] 4,274,866

[45] Jun. 23, 1981

[54] FLOTATION AND SINTERING OF SYNTHETIC MANGANESE CARBONATE

[75] Inventors: Ralph W. M. Lai, Lexington, Mass.; Edwin L. Owen, San Antonio, Tex.

[73] Assignee: Kennecott Copper Corporation, New York, N.Y.

[21] Appl. No.: 91,077

[22] Filed: Nov. 5, 1979

Related U.S. Application Data

[63] Continuation of Ser. No. 927,273, Jul. 24, 1978, abandoned.

[51] Int. Cl.[3] ..... B03D 1/02; C22B 1/16

[52] U.S. Cl. ..... 75/5; 75/80; 75/103; 75/121; 209/167; 423/49; 423/DIG. 4

[58] Field of Search ..... 75/1-5, 75/21, 80, 103, 121; 423/DIG. 4, 49-52; 209/166, 167

[56] References Cited

U.S. PATENT DOCUMENTS

| | | | |
|---|---|---|---|
| 2,069,365 | 2/1937 | Kellogg | 209/166 |
| 2,231,265 | 2/1941 | Gaudin | 209/167 |
| 2,259,420 | 10/1941 | Hills | 209/166 |
| 2,663,618 | 12/1953 | Babbitt et al. | 75/2 |
| 3,037,627 | 6/1962 | Hazen | 209/166 |
| 3,635,694 | 1/1972 | Chu | 75/3 |
| 3,734,715 | 5/1973 | Redman | 423/DIG. 4 |
| 3,864,118 | 2/1975 | Schumacher et al. | 75/3 |
| 3,942,974 | 3/1976 | Moreau et al. | 75/3 |
| 3,983,017 | 9/1976 | Szabo | 423/49 |
| 4,085,188 | 4/1978 | Subramanion et al. | 423/DIG. 4 |

FOREIGN PATENT DOCUMENTS

| | | | |
|---|---|---|---|
| 51-139519 | 12/1976 | Japan . | |
| 393607 | 5/1933 | United Kingdom | 75/2 |

OTHER PUBLICATIONS

Affidavit of Paul Ishimoto, translator U.S.P.T.O., of 5/16/79.

Grant, J., *Hakh's Chemical Dictionary*, 4th edition, McGraw Hill, New York, N.Y., p. 616, (1972).

Hattl, J. B., "Domestic Manganese From Butte Helps in Emergency", Eng. and Mining Journal, vol. 143, No. 1, pp. 56-58, (Jan./1942).

Gaudin, A. M.; *Flotation*, 2 ed., McGraw Hill, New York, N.Y., pp. 478-480.

*Primary Examiner*—Michael L. Lewis

*Attorney, Agent, or Firm*—John L. Sniado; Anthony M. Lorusso

[57] ABSTRACT

A process in which manganese is recovered from manganese nodules after the nodules have been treated to recover base metals such as copper, nickel, cobalt, and molybdenum. The process includes the steps of reacting the manganese in the nodules to yield a carbonate and subjecting the manganese carbonate to flotation. The manganese carbonate froth is collected from the top of a flotation cell, is dried to produce a manganese concentrate, and is sintered to produce a synthetic manganese oxide. Sintering of such concentrates at 1000° C. yields a product containing greater than 50% manganese.

The effect of reagent dosage, pH control, and temperature control on the yield of the synthetic manganese oxide is also disclosed.

6 Claims, 2 Drawing Figures

FLOTATION AND SINTERING OF SYNTHETIC MANGANESE CARBONATE

This is a continuation of application Ser. No. 927,273, filed July 24, 1978, now abandoned.

BACKGROUND OF THE INVENTION

With the earth's sources of copper diminishing rapidly, much emphasis has been placed on discovering new sources of this metal. One source of copper which has received much attention recently is manganese nodules which are found on the deep floors of oceans and lakes and which contain manganese, iron, copper, nickel, molybdenum, cobalt and other metal values.

Ocean floor deposits are found as nodules, loose-lying at the surface of the soft sea floor sediment, as grains in the sea floor sediments, as crusts on ocean floor hard rock outcrops, as replacement fillings in calcareous debris and animal remains, and in other less important forms. Samples of this ore material can readily be recovered on the ocean floor by drag dredging or by deep sea hydraulic dredging.

The character and chemical content of the deep sea nodules may vary widely depending upon the region from which the nodules are obtained. The Mineral Resources of the Sea, John L. Mero, Elsvier Oceanography Series, Elsevier Publishing Company, 1965, discusses on pages 127–241 various aspects of manganese nodules. For the purpose of illustrating this invention, the complex ores will be considered as containing the following approximate metal content range on a dry basis:

| METAL CONTENT ANALYSIS RANGE | |
|---|---|
| Copper | 0.8–1.8% |
| Nickel | 1.0–2.0% |
| Cobalt | 0.1–0.5% |
| Molybdenum | 0.03–0.1% |
| Manganese | 10.0–40.0% |
| Iron | 4.0–25.0% |

The remainder of the ore consists of oxygen as oxides, clay minerals with lesser amounts of quartz, apatite, biotite, sodium and potassium feldspars and water of hydration.

Prior to the present invention, of the many ingredients making up the manganese nodules, copper and nickel were emphasized and the manganese was not.

In general, the base metal values such as copper, nickel, cobalt and molybdenum are recovered from manganese nodules by reducing the nodules to break down the manganese oxide to enable the metal values contained therein to be leached in a leach liquor from which they are recovered. In practicing the present invention, the reduction may be performed by pyrometallurgical roasting operations or by a hydrometallurgical process known as the "cuprion" process which is disclosed in U.S. Pat. No. 3,938,017, the teachings of which are incorporated herein by reference. At this point, it should be noted that U.S. Pat. No. 3,938,017 does not disclose any method of treating the tailings which consist largely of manganese and iron even though manganese is a valuable metal which is employed in great quantities in making steel.

In U.S. patent application Ser. No. 927,272 entitled Production of Ferromanganese From Manganese Nodules, filed on even data herewith by Schapiro et al., a process is disclosed for concentrating manganese from nodule tailings. The present invention is an improvement on the process disclosed in that application.

SUMMARY OF THE INVENTION

The present invention is a process which upgrades the cuprion tailings from module processes to enable the manganese values in the tailings to be recovered economically. The process of the present invention provides a profitable outlet for material which heretofore was considered waste. The process includes the step of subjecting the cuprion tailings containing the manganese carbonate to froth flotation to produce a concentrate of manganese carbonate. An important aspect of the present invention involves conditions under which the manganese carbonate is concentrated. By critical control of the flotation reagent dosages, pH of the flotation cell and flotation temperature, the yield of synthetic manganese oxide is improved. Sintering the manganese carbonate concentrate to remove carbon dioxide, moisture and other volatiles produces a synthetic manganese oxide containing greater than 50% manganese. As used throughout this specification and claims, all percentages are by weight unless otherwise specified.

The synthetic manganese oxide may be reduced in a blast furnace to produce a ferromanganese alloy with a Mn-Fe ratio greater than 10. This produce can be used to great advantage in making steel.

Accordingly, it is an object of the invention to provide an improved process for recovering manganese from manganese nodules.

DESCRIPTION OF THE PREFERRED EMBODIMENTS

Figure 1:
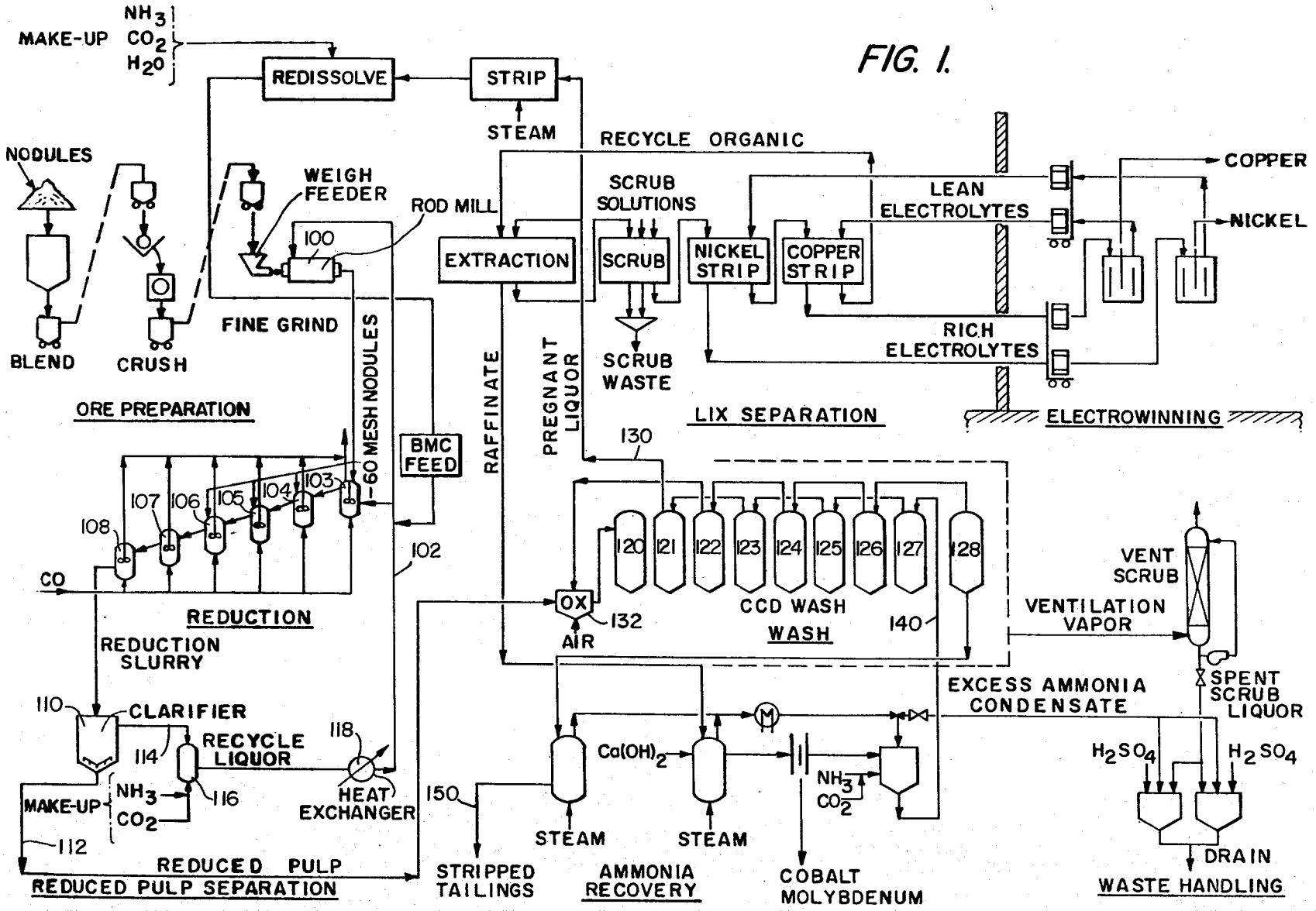
FIG. 1 is a diagram of a pilot plant useful in processing manganese nodules; and, FIG. 2 is a cross-sectional view of a flotation cell used to concentrate manganese in accordance with the present invention.

In accordance with the procedure set forth in U.S. patent application Ser. No. 927,272, a synthetic manganese oxide is produced from manganese nodules by the following steps:

reducing the $MnO_2$ phase of the manganese nodules;

leaching the reduced nodules in a leach liquor to solubilize the soluble non-ferrous base metals, i.e., copper, nickel, cobalt, and molybdenum;

forming manganese carbonate within the insoluble residue;

froth flotating the insoluble residue containing the manganese carbonate to produce a manganese carbonate concentrate; and, sintering the manganese carbonate concentrate to remove carbon dioxide, moisture and other volatiles to produce a synthetic manganese oxide containing greater than 50% Mn. This synthetic manganese oxide may then be reduced in a blast furnace to produce a ferromanganese alloy with an Mn-Fe ratio greater than 10.

As is stated above, during the leaching step, metals such as copper, nickle, cobalt, and molybdenum are solubilized. These solubilized values are then recovered from the leach liquor in the manner well known in this art. If the nodules are leached in an ammonical leach liquor containing cuprous ions, the residue from the leaching step, which are referred to as the cuprion tailings, may be subjected to steam stripping prior to froth flotation in order to recover the ammonia which is used to prepare fresh leach liquor. Thus, in a preferred embodiment of the invention, a steam stripped residue (cuprion tailings) from the leaching step is subjected to froth flotation.

The nodules may be reduced by a pyrometallurgical roasting process such as that set forth in U.S. Pat. No. 3,734,715 to M. J. Redman entitled EXTRACTION OF METAL VAUES FROM COMPLEX ORES issued May 22, 1973, the teachings of which are incorporated herein by reference. If the process disclosed in U.S. Pat. No. 3,734,715 is followed, the nodules are ground and reduced by gaseous reduction in, for example, a fluid bed roaster. The reduced calcine is then leached in the presence of an oxidizing agent with an aqueous solution of ammonia and an ammonium salt. Leaching solubilizes the metal values such as copper, nickel, cobalt, and molybdenum and leaves the manganese and iron in the solid residue. If leaching was not performed with an ammonium carbonate leach solution, the residue is then subjected to a solution containing from about 0.5 to about 4. M ammonium carbonate to convert the manganese in the residue to manganese carbonate. The residue is then treated in accordance with the procedure set forth above to concentrate the manganese carbonate.

In practicing the invention, the recovery of manganese from manganese nodules may be accomplished by additional steps in the so-called "cuprion" process set forth in U.S. Pat. No. 3,983,017 to L. J. Szabo entitled RECOVERY OF METAL VALUES FROM MANGANESE DEEP SEA NODULES USING AMMONIACAL CUPROUS LEACH SOLUTIONS issued Sept. 28, 1976. In the "cuprion" process, raw manganese deep sea nodules are reduced with cuprous ions ($Cu+$) in an aqueous ammoniacal ammonium carbonate solution. The cuprous ions reduce the manganese oxides in the nodules which enables metal values such as copper, nickel, cobalt, and molybdenum to be dissolved while leaving iron and manganese carbonate in the solid residue. In the reduction process, the manganese dioxide in the deep sea nodules is reduced by cuprous ions to manganese carbonate according to the reaction:

$$MnO_2 + 2\,Cu(NH_3)_2^{+} + 4\,NH_3 + CO_2 + H_2O \rightarrow MnCO_3 + 2\,Cu(NH_3)_4^{2+} + 2\,OH^- \quad (1)$$

Cupric ions indicated in equation (1) are reduced back to the cuprous state with carbon monoxide according to the reaction:

$$2\,Cu(NH_3)_4^{2+} + CO + 2OH^- \rightarrow 2\,Cu(NH_3)_2^{+} + 4\,NH_3 + CO_2 + H_2O \quad (2)$$

The net overall reaction for the reduction process is the sum of equations (1) and (2), or equation (3):

$$MnO_2 + CO \rightarrow MnCO_3 \quad (3)$$

The "cuprion" embodiment of the present invention is illustrated by the following example. At the outset, however, it is emphasized that the following description relates to a procedure that can be performed in a pilot plant. By extrapolating the results given for the pilot plant, however, one skilled in this art can design a commercial plant for processing large quantities of nodules in accordance with the present invention. The pilot plant is shown in FIG. 1.

The pilot plant was designed for one half ton per day nodule throughput, based on a 3½ percent solid slurry and with up to a three hour hold-up in the reduction section. The nodules utilized in the pilot plant process are in the condition that they are in after being mined from the deep sea ocean bottom. The nodules are first crushed in the primary crushing circuit to reduce their size to minus one inch. They are then passed into the second grinding circuit which includes an open circuit rod mill 100. The rod mill reduces the nodules from a particle size of minus six mesh to a particle size of approximately minus sixty mesh (U.S. Sieve Series).

The reduction-leach portion of the pilot plant is the location where the nodules are chemically reacted to make the soluble metals soluble in a strong ammoniacal ammonium carbonate solution. This is accomplished by reducing and converting the $MnO_2$ in the nodules to $MnCO_3$. The reduction circuit includes six reactors 103–108 connected in series. These reactors are sixty gallon capacity reactors which are used to a 42 gallon capacity in the actual processing. Gas sparging is directed underneath the agitator from the bottom of the reactor with a reduction gas containing 95 percent carbon monoxide. The reactors themselves are outfitted with gravity overflows so that there is a cascading system from the first (103) through the sixth (108) reactor. Normally, each of the first four reactors (103–106) is fed an equal amount of feed stock.

While the nodules are fed to the first four reactors, carbon monoxide is sparged into the bottom of each reactor as required. Preferably, the carbon monoxide is sparged into each reactor under pressure. The slurry in the fifth and sixth reactors is approximately 3.5 percent solids and the average residence time in the system is twenty minutes per reactor. The slurry overflowing the last reactor is flocculated to enhance settling before entering a clarifier. The clarifier is used to separate the liquid from the solids.

In order to reach a continuous steady state, the reactor vessels 103–108 must be loaded with start-up materials. Thus, each of the six reactors are filled with an ammonia-ammonium carbonate solution containing approximately 100 grams per liter total ammonia and between about 15 and 20 grams per liter total carbon dioxide. After the reactors are filled with the ammonia-ammonium carbonate solution, copper metal is added and is partially oxidized. The metal is added as a copper powder and is oxidized to convert some of the copper to cuprous ions. Enough copper metal is added so that 10 grams per liter copper in solutions results. The mixture in each reactor is analyzed to make sure that the cuprous ion concentration is at an acceptable level of about 7 grams per liter. If more cuprous ions are needed, this can be accomplished by passing the reducing gas through the bottom of the reactor.

After the reactor vessels have been loaded for start-up as set forth above, the manganese nodules are added to the first four reactors. The total rate of feed to the four reactors is about 30 pounds per hour of nodules. As the nodules are being fed into the reactors, carbon monoxide is sparged through the bottom of the reactors under a pressure of about 1–2 atmospheres at a total rate of about 70 standard cubic feet per hour.

Approximately 120 gallons per hour of reduction slurry enters the clarifier 110. The solids 112 leave the bottom of the clarifier in the form of a slurry with approximately a 40 percent solids content. The overflow 114 from the clarifier is clear liquid which constitutes the recycle reduction liquor 102. However, after leaving the clarifier, the recycle reduction liquor enters a surge tank (not shown) whereupon it is passed into an ammonia makeup unit 116. Gaseous ammonia and carbon dioxide are sparged into the ammonia makeup unit in order to keep the ammonia and carbon dioxide content of the liquid at a prescribed level. At steady state, that level is approximately 100 grams per liter ammonia and the $CO_2$ content about approximately 25 grams per liter. After leaving the makeup unit, the liquid is pumped by a metering pump through a heat exchanger 118 into the first reactor 103 and the rod mill 100. The heat exchanger removes heat that was generated in the process and lowers the temperature of the liquid from about 55° to about 40° C.

In the oxidation and wash-leach circuit, the clarifier underflow is combined with second stage wash liquor and the resulting slurry is oxidized with air to convert the cuprous ion in the clarifier underflow to cupric ion to facilitate future processing. The oxidized slurry is then pumped to a countercurrent decantation system (CCD) consisting of seven stages of countercurrent washing units. In the pilot plant, the wash-leach steps are carried out on a batch basis in nine tanks 120 to 128 which are used to simulate a countercurrent wash system. In the wash-leach system, the metal solubilization is completed as the displacement wash process is carried out. Fresh wash liquor 140 is added to the seventh stage of the system as a solution containing 100 grams per liter ammonia and 100 grams per liter carbon dioxide. Liquor is transferred from one tank of the settled slurry every twelve hours to another appropriate tank in the system to effect the countercurrent washing. The carbon dioxide concentration varies throughout the washing system and exits in the pregnant liquor 130 which contains approximately 65 grams per liter $CO_2$. Pregnant liquor 130 containing the soluble metals to be recovered, is decanted from the first wash stage and is pumped to a surge tank (not shown). Fresh ammonia solution without metals is added (not shown) to the last solids wash stage 121. The metal values in solution range from approximately 0 in the fresh wash liquor 140 to between 4–8 grams per liter copper and 5–10 grams per liter nickel in the pregnant liquor 130.

After the wash-leach step, the pregnant metal bearing liquor is piped off for further processing as is explained below. The second stage wash is recycled back to the oxidation reactor 132. The residue (cuprion tailings), which are nothing more than reduced nodules washed of most of their non-ferrous metal values and with the manganese converted to manganese carbonate, are sent to a surge tank (not shown). From the surge tank, they are then pumped to a steam stripping operation where the ammonia and $CO_2$ are driven off. These cuprion tailings are then treated in accordance with the present invention to recover manganese. It should be noted that in this embodiment of the invention, the manganese in the cuprion tailings has been converted to manganese carbonate.

It should also be noted that the pregnant metal bearing liquor 130 contains recoverable metals such as copper, nickel, cobalt, and molybdenum. Initially, the pregnant liquor is treated to recover copper and nickel. Basically, the preferred treatment consists of ion exchange with an organic extractant such as oxime to selectively extract copper and nickel followed by electrowinning to recover the copper and nickel metal values. Details for procedures for recovering these metals are set forth in U.S. Pat. No. 3,853,725 to Ronald R. Skarbo, entitled SELECTIVE STRIPPING PROCESS, the teachings of which are incorporated herein by reference. In this type of procedure, initially the copper and nickel are coextracted by an organic extractant in a series of mixer/settler units. The organic extractant is LIX-64N in a kerosene base which is an extractant sold by General Mills Chemicals, Inc. The copper and nickel free liquor (raffinate) is sent to a storage tank before it is steam stripped.

The organic extractant which contains copper and nickel values is washed with an $NH_4HCO_3$ solution followed by an ammonium sulfate solution to remove ammonia picked up during extraction. This scrubbing operation is carried out in another series of mixer settlers. The organic extractant is then stripped with a weak $H_2SO_4$ solution (pH about 3) to preferentially remove nickel. Thereafter, the copper is stripped, which is accomplished by using a stronger (160 g/l) $H_2SO_4$ solution. The copper and nickel-free organic extractant is recycled to the metal extraction circuit of the LIX process.

The raffinate which contains only cobalt, molybdenum and some trace inpurities that were not extracted into the organic phase is sent into a surge tank for future processing to recover cobalt and molybdenum. In the cobalt and molybdenum recovery circuit, the ammonia and $CO_2$ are stripped from the raffinate thereby precipitating cobalt. The ammonia and $CO_2$ are condensed and sent back to the process for recycling. The cobalt precipitate is separated from the liquor and the liquor is subsequently treated with calcium ions to precipitate the molybdenum. The resulting slurry is agitated and then allowed to settle. The solution which no longer contains cobalt and molybdenum is recycled back to the process as fresh wash liquor. Ammonia and $CO_2$ are added to the solution to bring it up to the prescribed concentration.

Of course, the recovery of metal values other than the manganese product described herein does not constitute part of the invention per se; however, in order for the present invention to be economical, as many of the metals in the manganese nodules as are possible to recover should be recovered along with the manganese product which results from practicing the present invention.

The steam stripped cuprion tailings 150 which are rich in manganese carbonate, are treated in accordance with the present invention to concentrate the manganese carbonate; and, the manganese carbonate concentrate is sintered. A characterization of the steam stripped cuprion tailings is given below:

CHARACTERIZATION

The cuprion tailings material consists primarily of three distinct optically differentiable materials. These comprise more than 90% of the weight of the cuprion tailings. The three materials are:

(1) a crystalline phase consisting of an impure manganese carbonate ($MnCO_3$) which is present generally as spheroidal grains with a median diameter less than 10 microns;

(2) a non-manganese material rich in aluminum and silicon designated phase "A";

(3) a non-manganese material rich in iron designated phase "B".

The manganese carbonate is present as single particles or aggregates of particles not intergrown with phases "A" and "B". The occurrence of the carbonate as a physically and chemically distinct solid permits mechanical separation. Phases "A" and "B" contain the residual base metals Cu, Ni, and Cu along with a large fraction of the iron.

The manganese carbonate phase makes up 40–50% of the cuprion tailings. The balance is made up of phases "A" and "B" in major proportions (15–30% of each).

Figure 2:
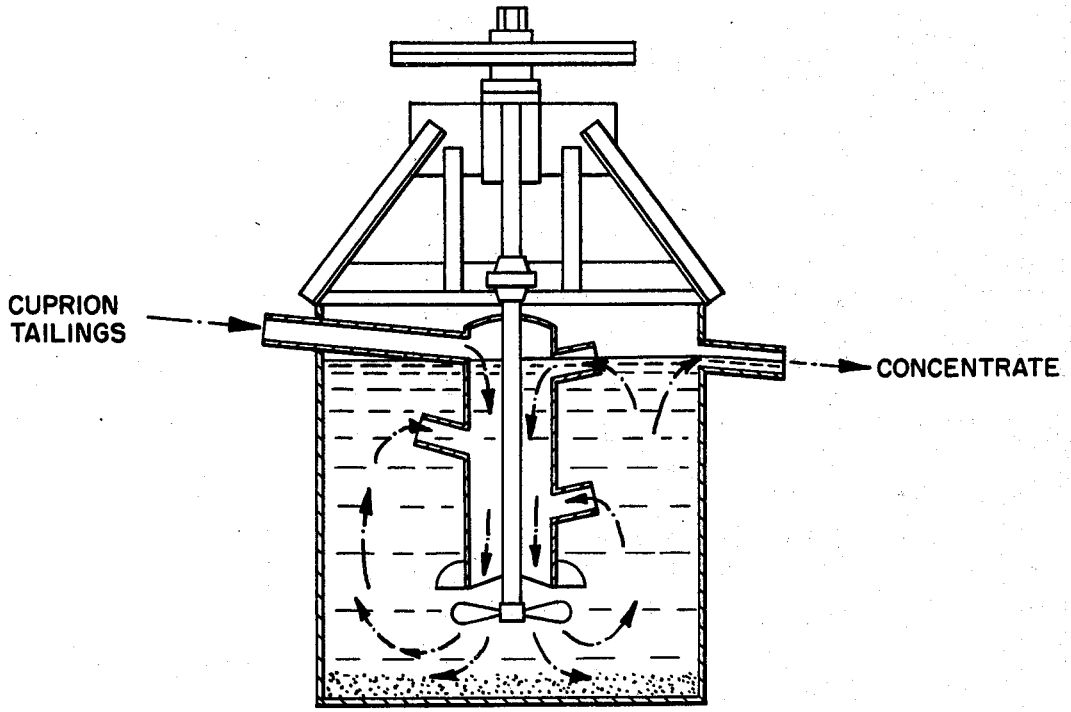

In accordance with the present invention, cuprion tailings 150 are added to a bank of flotation cells, such as the one shown in FIG. 2, which contains water, sodium silicate, and a fatty acid. The mixture is agitated at a high speed to produce a foam or froth. The bubbles in the froth carry the concentrated manganese carbonate to the top of the cells while the remainder of the cuprion tailings, i.e., phases "A" and "B", settle to the bottom of the cells.

Referring to FIG. 1, steam stripped cuprion tailings 150 produced in the pilot plant are upgraded by froth flotation in accordance with the present invention. For a 0.5 ton per day nodule feed to the pilot plant, 0.55 ton (1100 lbs.) of cuprion tailings are produced. [In part of the pilot plant shown in FIG. 1, copper and nickel are removed from the nodules, but carbon dioxide ($CO_2$) is added to this weight more than making up the difference; hence the cuprion tailings are heavier than the starting material.]0.55 Ton of cuprion tailings per day are continuously fed to a bank of two flotation cells, each containing 40 liters of water. Into each cell is metered a fattey acid and sodium silicate. The fatty acid dosage is within the range of 0.5–3.0 lbs per ton of cuprion tailings and the sodium silicate dosage is between the range of 0.5 to 10 lbs. per ton of cuprion tailings. An amount of mineral acid, such as sulfuric acid, is also added to lower the pH of the cuprion tailings from 9–10 to 6.6–8.4. The pulp density in the cells is in the range of 10–22% solids, and the retention time is in the range of 14–35 minutes.

The froth containing the manganese carbonate concentrate continuously overflows the cells at the rate of 17 lbs/hr (dry basis) and the underflow is removed at the rate of 29 lbs/hr from the bottom of the cells. The underflow is pumped to a settling tank and is eventually discarded to a tailings pond or the like.

The carbonate is sintered at a temperature of 1000° C. to remove $CO_2$, moisture and other volatiles. Sintering may take place in any number of suitable types of furnaces. Reactions occurring during sintering are:

1. decomposition of manganese carbonate $$MnCO_3(S) \xrightarrow{\Delta} MnO(S) + CO_2(g)$$

2. evaporation of water $$H_2O(l) \xrightarrow{\Delta} H_2O(g)$$

A method is to pelletize the concentrate in a disc pelletizer followed by induration in a grate-kiln (travelling grate - rotary kiln). The product is hard spheres ($\frac{3}{8}''$–$\frac{5}{8}''$ diameters) of sintered MnO - FeO mixture with a Mn to Fe ratio greater than 10 with a small amount of oxides of Cu, Ni, Co and the other metals orignally present in manganese nodules.

The sinter is a suitable feed to a ferromanganese blast furnace. In the blast furnace, sinter, coke, and limestone are charged, and the sinter reduced to yield a metallic manganese-iron alloy.

In the ferromanganese blast furnace, the sintered pellets are charged with coke and limestone, and the oxides are reduced at temperatures in the range of 1550°–1700° C. to the metals. The typical overall reactions are:

$$2MnO + C = 2Mn + CO_2$$

$$2FeO + C = 2Fe + CO_2$$

All of the MnO and FeO is reduced; thus, the Mn to Fe ratio is greater than ten in the metallic product, which also includes a small amount of impurity metals, Cu, Ni, Co, and Mo. The liquid slag from the process consists of the unreduced $SiO_2$ (silica) from the pellets plus CaO (lime) from the limestone in the charge.

The present invention is based on a discovery that reagent dosages of the flotation cell is an important factor to control. More specifically, it has been discovered that the use of sodium silicate in the flotation cell segregates the iron in the cuprion tailings from the manganese which overflows the flotation cell. Indeed, by following the present invention, the manganese carbonate that is floated contains less than 1% iron.

Other aspects of the present invention involve other process parameters. In connection with this point, it has been discovered that pulp pH, temperature of the flotation cell, and the amount of fatty acid utilized in the flotation cell are significant parameters in conjunction with the use of sodium silicate.

In accordance with the present invention, fatty acid dosage is between the range of 0.5–3.0 lbs. per ton of cuprion tailings. The sodium silicate dosage is between the range of 0.5–10 lbs. per ton of cuprion tailings.

In connection with fatty acids, this material is widely used in the flotation art and is used to describe a carboxylic acid containing 12 to 18 carbon atoms. These acids are available commercially and are usually obtained as a mixture of acids. Saturated and unsaturated acids that are available include:

| SATURATED ACIDS | |
|---|---|
| Lauric = $C_{12}$ | Palmitic = $C_{16}$ |
| Myristic = $C_{14}$ | Margaric = $C_{17}$ |
| Pentadecanoic = $C_{15}$ | Stearic = $C_{18}$ |
| UNSATURATED ACIDS | |
| Myristoliec = $C_{14}$ | Oleic = $C_{18}$ |
| Palmitoleic = $C_{16}$ | Linoleic = $C_{18}$ |
| Hexadecadienic = $C_{16}$ | |

In accordance with another important aspect of the invention, it has been discovered that the yield of manganese carbonate is improved if the pH of the flotation cell is maintained between the value of 6.6–8.4.

The pH of the cuprion tailings 150 is between the range 9–10. To lower the pH to the range of 6.6–8.4, a mineral acid is added to the flotation cell. The preferred mineral acid is sulfuric acid.

In accordance with another aspect of the invention, it has been discovered that the yield of manganese carbonate is improved if the flotation cell is operated at a temperature between the range of 55°–80° C. This temperature may be achieved by heating the water that is added to the flotation cell prior to the introduction of the cuprion tailings.

Additional examples are given below to illustrate the flotation responses in terms of concentrate grade, recovery of manganese, and the flotation time. In the following flotation experiments, fatty acid was used as the collector and sodium silicate as a dispersant.

DESCRIPTION OF FLOTAION PROCEDURE

The flotation experiments were performed in a 3.5 liter Fagergren flotation machine. The standard procedure is as follows:

A specified dosage of sodium silicate was added to sea water at 80° C., followed by a three-minute conditioning period. This sea water was roughly half of the total sea water to be added and the amount was varied for each test depending on the % solids. Next, the cuprion tailings (about 50% to 56% solids) were slowly added, followed by a five-minute conditioning period. The pulp was then heated up to 65° C. in order to insure a flotation temperature of approximately 60° C. The fatty acid was added, followed by a three-minute conditioning period, and then most of the remaining sea water was added. After one mintue of conditioning, the sulfuric acid was then added for pH control, followed by a five-minute conditioning period. When the sulfuric acid was first added, there was an increase in the height of froth. During the conditioning, this level dropped back to its prior height. To prevent overflow during this time, a small amount of sea water (80° C.) was not added until after the flotation cell was conditioned for one minute after this final sea water addition. The flotation was now ready to begin. The air was turned on and adjusted during the flotation to obtain a steady froth rate. For all tests, the total volume of slurry just before flotation was kept the same. After the flotation, the concentrates and the tailings were filtered, dried and weighed and then sent for chemical analyses and insoluble material measurements.

One set of experiments was conducted to evaluate the effects of fatty acid and sodium silicate on the grade and recovery of manganese concentrate. The experiments were performed with the standard flotation procedure described above. The flotation pulp was kept at 16% solids, and a flotation pH of 8.5 was used. Table I summarizes the results.

TABLE I

Flotation Response as a Function of Fatty Acid and Sodium Silicate Usage

| Test No. | Na Silicate ml | Fatty Acid ml | Product | Wt. % | % Mn. | Distrib'n. % |
|---|---|---|---|---|---|---|
| 1 | 10 | 0.7 | Conc. | 57.4 | 32.7 | 68.9* |
| | | | Tails | 42.6 | 19.9 | 31.1 |
| 2 | 25 | 0.5 | Conc. | 41.9 | 34.0 | 52.1* |

TABLE I-continued

Flotation Response as a Function of Fatty Acid and Sodium Silicate Usage

| Test No. | Na Silicate ml | Fatty Acid ml | Product | Wt. % | % Mn. | Distrib'n. % |
|---|---|---|---|---|---|---|
| | | | Tails | 58.1 | 22.1 | 47.9 |
| 3 | 15 | 0.5 | Conc. | 48.6 | 32.8 | 59.1* |
| | | | Tails | 51.4 | 21.5 | 40.9 |
| 4 | 20 | 0.7 | Conc. | 56.6 | 32.4 | 68.5* |
| | | | Tails | 43.4 | 19.4 | 31.5 |
| 5 | 5 | 0.5 | Conc. | 51.6 | 31.4 | 60.3* |
| | | | Tails | 48.4 | 22.0 | 39.7 |
| 6 | 15 | 0.5 | Conc. | 48.5 | 32.2 | 58.6* |
| | | | Tails | 51.5 | 21.4 | 41.4 |

*% Distribution of Concentrate = % Recovery

The above results indicate that a chemical dosage of 0.7 ml fatty acid and 20 ml sodium silicate gives the best overall recovery and grade.

Additional experiments were performed at pH 6.6 with varying levels of chemical dosage and percent solids. The range of sodium silicate used was between 10 ml and 30 ml, with the fatty acid to sodium silicate ratio at 0.035. The percent solids ranged from 8 to 24. The standard flotation procedure was used during the tests. The flotation time required for complete flotation was measured for each test. After the flotation, the products were dried, sent for chemical analyses, and the metallurgical balance was calculated.

The experimental results are summarized in Table II.

TABLE II

Metallurgical Balance on Manganese Carbonate Flotation

| Test No. | Test Wt. g. | Test % Solid | Reagents, ml Na Sil. | Reagents, ml Oleic | Reagents, ml $H_2SO_4$ | Product | Wt. % | % Mn. | % Distrib. of Mn | Flotation Time, Min. |
|---|---|---|---|---|---|---|---|---|---|---|
| 1 | 675 | 16 | 20 | 0.7 | 60 | Conc. | 56.0 | 34.7 | 71.6 | 21 |
| | | | | | | Tails | 44.0 | 17.5 | 28.4 | |
| 2 | 493 | 12 | 10 | 0.35 | 45 | Conc. | 43.2 | 35.3 | 56.6 | 16 |
| | | | | | | Tails | 56.8 | 20.6 | 43.4 | |
| 3 | 867 | 20 | 30 | 1.05 | 75 | Conc. | 62.0 | 33.8 | 77.9 | 35 |
| | | | | | | Tails | 38.0 | 15.6 | 22.1 | |
| 4 | 320 | 8 | 20 | 0.7 | 30 | Conc. | 62.7 | 35.4 | 83.1 | 12 |
| | | | | | | Tails | 37.8 | 12.1 | 16.9 | |
| 5 | 1070 | 24 | 20 | 0.7 | 90 | Conc. | 62.9 | 32.4 | 75.7 | 45 |
| | | | | | | Tails | 37.1 | 17.6 | 24.3 | |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A process for recovering a ferromanganese product from manganese nodules comprising the following steps:

a. reducing the manganese oxides in the nodules to enable non-manganese and non-iron metal values to be leached;

b. leaching non-manganese and non-iron metal values;

c. reacting the manganese to form a crystalline manganese carbonate phase which is distinct from a remaining phase;

d. froth floating the crystalline manganese carbonate phase and the remaining phase in a froth flotation cell to separate the crystalline manganese carbonate from the remaining phase, said froth flotation being performed in the presence of a fatty acid as a collector and sodium silicate as a dispersant, at a temperature between the range of 55°–80° C. and at a pH of 6.6 to 8.4;

e. withdrawing the crystalline manganese carbonate from the top of the flotation cell to collect a manganese concentrate; and f. sintering the manganese concentrate to produce a ferromanganese product.

2. The process as set forth in claim 1 wherein steps b and c are combined by leaching the nodules in an ammoniacal ammonium carbonate leach liquor.

3. The process as set forth in claim 2 wherein the residue is steam stripped to remove ammonia prior to floating the residue in step d.

4. The process as set forth in claim 1 wherein in step a the reducing is performed pyrometallurgically.

5. The process as set forth in claim 1 wherein in steps a, b, and c are combined by treating the nodules in an ammoniacal ammonium carbonate leach liquor containing cuprous ions.

6. The process as set forth in claim 1 wherein in step f the concentrate is sintered to produce a product having an Mn to Fe ratio greater than 10.

* * * * *